United States Patent [19]

Bird et al.

[11] 4,362,534

[45] Dec. 7, 1982

[54] SAFETY FUEL ADMIXTURE APPARATUS

[75] Inventors: Kenneth I. W. Bird, Aldershot; Evan S. Thomas, Farnborough, both of England

[73] Assignee: The Secretary of State for Defence in Her Britannic Majesty's Government of the United Kingdom of Great Britain and Northern Ireland, London, England

[21] Appl. No.: 210,229

[22] Filed: Nov. 25, 1980

[51] Int. Cl.[3] ..... C10L 1/22

[52] U.S. Cl. ..... 44/62; 44/2; 241/46.17; 241/101.5; 244/135 R

[58] Field of Search ..... 44/62, 51, 2; 123/1 A, 123/23, 198 A; 241/46.17, 101.5, 101.6, 101 B; 244/135

[56] References Cited

U.S. PATENT DOCUMENTS 1,656,678 1/1928 Pawlikowski ..... 123/23

3,925,032 12/1975 Osmond et al. ..... 44/62

*Primary Examiner*—Charles F. Warren

*Assistant Examiner*—Y. Harris-Smith

*Attorney, Agent, or Firm*—Stevens, Davis, Miller & Mosher

[57] ABSTRACT

Apparatus for admixing dispersion inhibitive polymer into liquid hydrocarbon fuel and comprising a polymer supply hopper mounted on a fuel feed tube and a rotary mill having a cutting edge for cutting swarf from the polymer and a duct for conveying the swarf to the interior of the tube.

16 Claims, 2 Drawing Figures

SAFETY FUEL ADMIXTURE APPARATUS

The present invention relates to safety fuels, that is to say liquid hydrocarbon fuels which carry an anti-misting additive for fire protection purposes. It is particularly concerned with apparatus and process for metering the additive into the fuel.

Typical safety fuels are described in UK Patent Specification No. 1332593 and may comprise a liquid hydrocarbon fuel containing dissolved therein a small amount of a polymer such as an alkylated polystyrene prepared by the addition polymerization of an alkyl styrene. The polymer is most conveniently supplied as a high solid dispersion in a suitable carrier in billet form.

Safety fuels are of particular value to vehicles and craft, especially aircraft, where there is a risk of fuel tanks being ruptured in an accident. It has been found advantageous not to introduce the additive into the fuel until the time of loading it into the craft. However, at that juncture both the power required to effect complete admixture and the required accuracy of metering can be difficult to obtain.

The present invention provides apparatus and process for admixing safety fuel additive into a liquid fuel.

According to the present invention safety fuel admixing apparatus comprises:

a liquid fuel feed tube, a hopper for supplying polymer and attached to the feed tube, and a rotary mill located between the hopper and the feed tube, the mill having a cutting edge protruding into the hopper and an associated duct for conveying the polymer swarf into the fuel feed tube. The apparatus may also have a beater, perhaps integral with the mill, for breaking the swarf into pieces and for threshing it with the fuel in order to assist dissolution of the polymer in the fuel.

In one embodiment of the invention the hopper comprises a cylindrical tube in which the polymer, as a dispersion in billet form, is such a push fit as to afford a seal against the egress of the liquid fuel, and the mill, which has an integral beater, has a flat circular face forming a base to the hopper, with the cutting blade projecting from the face, and a slot adjacent the blade for conveying polymer swarf from the hopper to the interior of the beater, the beater being thus arranged to fragment the polymer swarf and to thresh it in the fuel.

The apparatus may also have a hopper feed device comprising a belted magazine of billets, means for passing the belt across the mouth of the hopper and a plunger for pushing billets out of the belt and into the hopper.

The apparatus is preferably located in a fuel supply system with a pump downstream thereof such that fuel is sucked or syphoned rather than forced under positive pressure through it, thus obviating special seals against the leakage of fuel through the hopper. Indeed in one embodiment of the invention the fuel supply duct to the admixture apparatus incorporates a choked orifice so that the pump draws fuel into the admixture apparatus at a controlled rate and at the same time draws a billet of polymer thrugh the hopper. The hopper may have, preferably extending a short way from the base thereof only, longitudinal guides preventing rotation of the billet.

In the aircraft context, the apparatus is advantageously incorporated in a fuel supply bowzer together with a blender, whereby fuel is sucked from the bowzer by the pump through the admixing apparatus and the blender and then passed to the aircraft fuel tanks.

According to another aspect of the invention a process for the admixture of polymer dispersion into a liquid fuel comprises:

feeding the polymer dispersion in billet form through a hopper attached to a feed tube of the liquid fuel, cutting a desired amount from the polymer by means of a rotary mill having a cutting edge projecting into the hopper and mounted between the hopper and the feed tube, and conducting the polymer swarf so formed through a duct in the mill into the liquid feed tube.

Preferably the process also comprises fragmenting the swarf and threshing it in the liquid by means of a beater integral with the mill. The process may comprise drawing a billet of polymer through the hopper and drawing fuel from a reservoir thereof via a choked orifice to control the fuel flow rate, passing a belted billet magazine across the hopper mouth and driving billets from the magazine into the hopper, and further blending the fuel and polymer dispersion in a separate blender, just before passing the safety fuel so formed into the fuel tank supplying the fuel burning means, e.g. the fuel tanks of an aircraft.

A safety fuel admixing device and process in accordance with the invention will now be described by way of example with reference to the accompanying drawings, of which:

Figure 1:
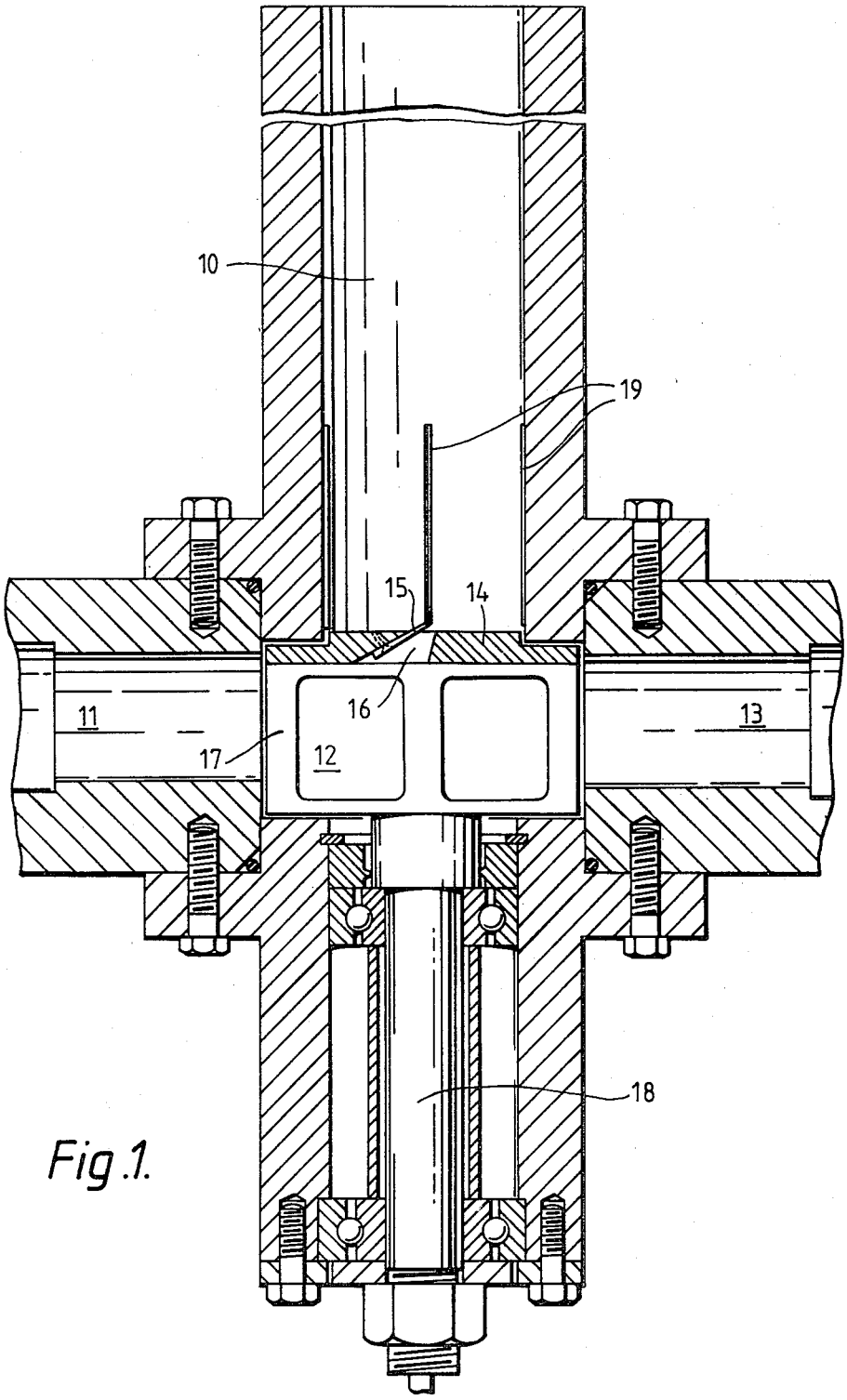
FIG. 1 is a longitudinal section of the device.

The safety fuel admixture device shown in FIG. 1 has a polymer feed hopper 10, a fuel inlet 11, an admixture chamber 12 a fuel outlet 13 and a rotary mill 14. The mill has a substantially flat face forming a base to the hopper 10 with a cutter 15 protruding into the hopper and a slot 16 adjacent to the cutter connecting the hopper with the chamber 12. The mill also has beater vanes 17. The cutter 14 extends radially from the centre of the mill face to the circumference thereof. The mill 14 has a drive shaft 18.

The hopper 10 is cylindrical and is smooth sided except for longitudinal guide blades 19 projecting into a lower part thereof to prevent billet rotation, so that polymer billets therefor fit slidably but sealedly therein. Thus, with a billet in the hopper urged against the mill 14, at constant pressure, fuel passing through the chamber 12 at a constant rate, and the mill 14 rotating at a constant rate, a sliver of polymer swarf is cut from the billet and passes into the chamber 12. Being drawn by the fuel out of the chamber 12 it is fragmented by the beaters 17 and mixed into the fuel.

Figure 2:
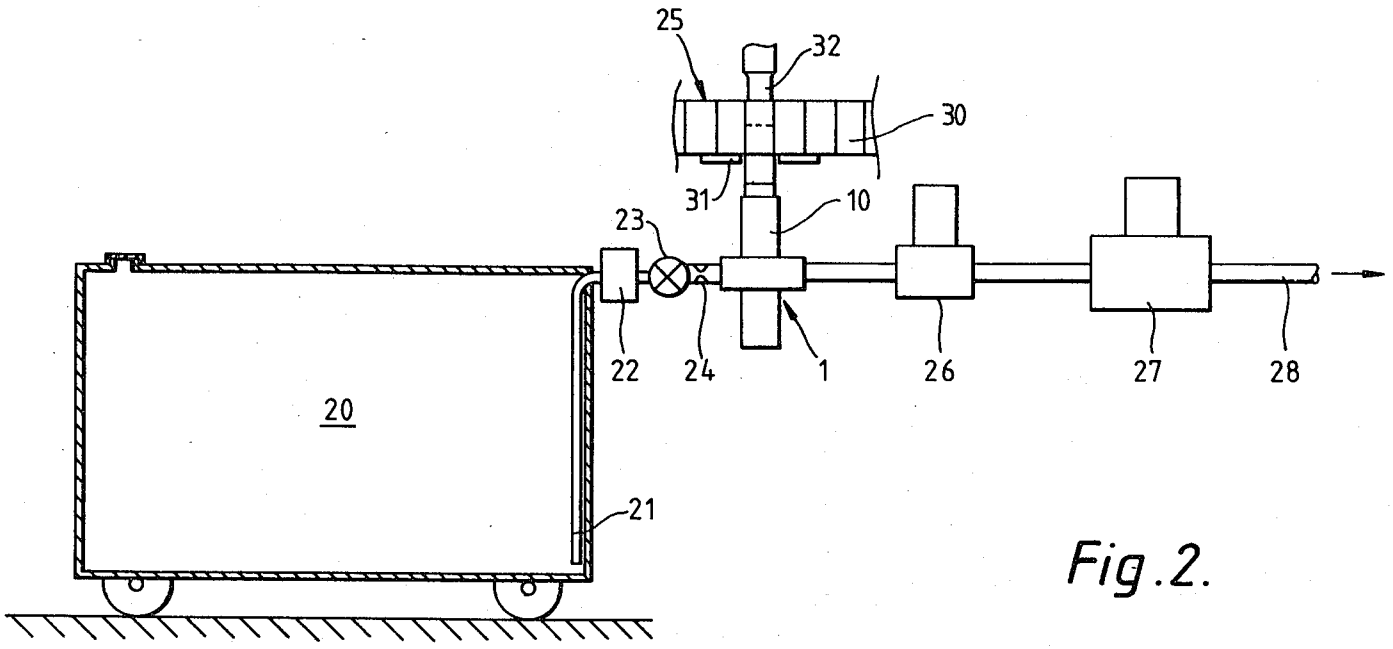
FIG. 2 is a schematic diagram of an aircraft fuel supply apparatus incorporating the device.

The fuel supply apparatus illustrated in FIG. 2 comprises, associated with a bowzer 20, a fuel syphon pipe 21, a filter 22, a cock 23, a restriction 24, a fuel admixture device 1, hopper feed apparatus 25, a blender 26, a pump 27, and a fuel supply pipe 28. The hopper feed apparatus comprises a magazine 30 of polymer billets in belt form, guide means 31 therefor and drive means and store therefor (not shown), and a plunger device 32 for driving billets from the belt 30 into the hopper 10.

For operation of the apparatus shown in FIG. 2, the bowzer 20 will have been conveyed to an aircraft and the pipe 28 connected to the aircraft fuel reservoir.

With the cock 23 and the remainder of the apparatus switched on the magazine 30, guided by the means 31 conveys a polymer billet to the path of the plunger 32 which ejects it from the magazine and into the hopper 10. The pump 27 draws the billet down the hopper 10 onto the cutter 15 and at the same time draws fuel from the bowzer is a quantity metered by the restriction 24. Within the admixture device the polymer swarf and fuel are admixed as described above. The mixture is completed in the blender 26 just before the mixture passes as safety fuel into the aircraft fuel tanks.

Although it does not form part of the present invention as such a suitable blender 26 may comprise a Silverson (TM) AX Mixing head modified to operate at 10,000 rpm.

I claim:

1. In combination with an apparatus for supplying liquid fuel to the fuel tank of a vehicle having a liquid fuel reservior and a fuel pump, safety fuel admixing means comprising:

a liquid feed tube connected to an outlet from said liquid fuel reservoir, a hopper for supplying polymer is solid form and attached to said liquid feed tube, and a rotary mill located between said hopper and said liquid feed tube, said mill having a cutting edge protruding into said hopper for cutting swarf from the polymer, and an associated duct for conveying the polymer swarf into said fuel feed tube.

2. Apparatus as claimed in claim 1 and wherein said hopper comprises a cylindrical tube in which the polymer, as a dispersion in billet form, is such a push fit as to afford a seal against the egress of the liqid fuel, and said mill has a flat circular face forming a base to said hopper, with said cutting blade projecting from the face, and a slot adjacent said blade for conveying polymer swarf from said hopper to the interior of the fuel feed tube.

3. Apparatus as claimed in claim 1 and having a beater for breaking the swarf into pieces and for threshing it with the fuel.

4. Apparatus as claimed in claim 3 and wherein said beater is integral with said mill.

5. Apparatus as claimed in claim 4 and wherein said hopper comprises a cylindrical tube in which the polymer, as a dispersion in billet form, is such a push fit as to afford a seal against the egress of the liquid fuel, and said mill has a flat circular face forming a base to said hopper, with said cutting blade projecting from said face and a slot adjacent said blade for conveying polymer swarf from said hopper to the interior of said beater.

6. Apparatus as claimed in claim 1 and having a hopper feed device comprising a belted magazine of billets, means for passing the belt across the mouth of said hopper and a plunger for pushing billets out of the belt and into said hopper.

7. Apparatus as claimed in claim 1 wherein said fuel pump is located in said feed tube downstream of said hopper.

8. Apparatus as claimed in claim 7 comprising a choked orifice in said feed tube, whereby said pump draws fuel into the admixture means (apparatus) at a controlled rate and at the same time draws a billet of polymer through said hopper.

9. Apparatus as claimed in claim 2 and wherein said polymer has longitudinal guides extending a short way from the base.

10. Apparatus as claimed in claim 1 comprising a blender in said feed tube and downstream of said hopper.

11. Apparatus in accordance with claim 1 as an aircraft fuel supply bowser (bowzer incorporating apparatus in accordance with claim 1).

12. On a bowser for supplying liquid fuel to the fuel tank of an aircraft, said bowser having a liquid fuel reservoir and a fuel pump, fuel admixing means, comprising:

a liquid fuel feed tube connected to an outlet from said reservoir, a hopper for supplying polymer in solid form and attached to said feed tube, a rotary mill in the base of said hopper, a beater in said tube and integral with said mill, a hopper feed device for (leading) loading said hopper with said polymer, and a fuel pump downstream of said beater, said hopper comprising a cylindrical tube for receiving the polymer in billet form as a push fit, and having longitudinal guides extending a short way from the base thereof to prevent billet rotation, and said mill having a flat circular face with a cutting blade projecting from said face into said hopper, and a slot adjacent said blade for conveying polymer swarf from said hopper to the interior of said beater.

13. Apparatus as claimed in claim 12 and wherein said hopper feed device comprises a belted magazine of billets, means for passing the belt across the mouth of said hopper and a plunger for pushing billets out of the belt and into said hopper.

14. A process for the admixture of polymer dispersion into a liquid fuel while pumping the fuel from a reservoir to the fuel tank of a vehicle such as an aircraft, the process comprising:

feeding the polymer dispersion in billet form through a hopper attached to a feed tube of the liquid fuel, cutting swarf from the polymer by means of a rotary mill having a cutting edge projecting into said hopper and mounted between said hopper and said feed tube, and conducting the polymer swarf so formed through a duct in said mill into said liquid feed tube.

15. A process as claimed in claim 14 and comprising also fragmenting the swarf and threshing it in the liquid by means of a beater integral with said mill.

16. A process as claimed in claim 14 and comprising drawing a billet of polymer through said hopper and drawing fuel from a reservoir thereof via a choked orifice to control the fuel flow rate, passing a belted billet magazine across the hopper mouth and driving billets from the magazine into the hopper, and further blending the fuel and polymer dispersion in a separate blender, just before passing the safety fuel so formed into the fuel tank of an aircraft.

* * * * *

UNITED STATES PATENT AND TRADEMARK OFFICE

CERTIFICATE OF CORRECTION

PATENT NO. : 4,362,534

DATED : December 7, 1982

INVENTOR(S) : Kenneth I.W. BIRD, et al.

It is certified that error appears in the above-identified patent and that said Letters Patent is hereby corrected as shown below:

Column 3, line 18, after "vehicle" insert -- and--,
line 19, change "reservior" to --reservoir--;
line 23, change "is" to --in--;
line 34, change "liqid" to --liquid--;
line 64, delete "(apparatus)".

Column 4, line 10, delete "(bowzer incorporating appara-";
line 11, delete "tus in accordance with claim 1).";
line 22, delete "(leading)".

Signed and Sealed this

*Twenty-sixth* Day of *February 1985*

[SEAL]

*Attest:*

DONALD J. QUIGG

*Attesting Officer* *Acting Commissioner of Patents and Trademarks*